United States Patent [19]

Lanier

[11] Patent Number: 4,559,960

[45] Date of Patent: Dec. 24, 1985

[54] SEWER CLEANER APPARATUS

[75] Inventor: William D. Lanier, Albany, Ga.

[73] Assignee: City of Albany, Georgia, Albany, Ga.

[21] Appl. No.: 543,979

[22] Filed: Oct. 20, 1983

[51] Int. Cl.[4] ..... B08B 9/04

[52] U.S. Cl. ..... 134/166 C; 134/167 C; 134/198; 15/104.06 R

[58] Field of Search ..... 134/166 C, 167 C, 198, 134/172; 15/104.06 R, 104.03

[56] References Cited

U.S. PATENT DOCUMENTS

| | | | |
|---|---|---|---|
| 2,461,517 | 2/1949 | Carnevale | 134/167 C |
| 2,897,524 | 8/1959 | Varner et al. | 15/104.06 R |
| 3,262,143 | 7/1966 | Reinhart | 15/104.06 R |
| 3,495,546 | 2/1970 | Brown et al. | 15/104.06 R |
| 3,525,111 | 8/1970 | Von Arx | 15/104.06 R |
| 4,073,302 | 2/1978 | Jones | 134/167 C |

FOREIGN PATENT DOCUMENTS

| | | | |
|---|---|---|---|
| 521033 | 7/1976 | U.S.S.R. | 134/166 C |

*Primary Examiner*—Stephen Marcus
*Assistant Examiner*—Renee S. Kidorf
*Attorney, Agent, or Firm*—Neuman, Williams, Anderson & Olson

[57] ABSTRACT

This invention relates to apparatus for cleaning sewers or the like and more particularly to apparatus which is fast, through and otherwise effective in cleaning sewers and which is very inexpensive in construction and operation, requiring no supply of electrical, mechanical or fluid power thereto and requiring minimal effort and manpower for operation. The apparatus is readily controlled to obtain optimum performance under varying conditions, is highly reliable and is relatively light in weight and readily transported from one place to another.

4 Claims, 2 Drawing Figures

SEWER CLEANER APPARATUS

BACKGROUND OF THE INVENTION

Various types of apparatus have heretofore been used or proposed for use in cleaning sewers but such have had many limitations and have not been altogether satisfactory. In general, such types of apparatus have been very complicated and expensive and have been difficult to operate and/or have had very limited effectiveness in removing the type of debris which is commonly found in sewers.

SUMMARY OF THE INVENTION

This invention was evolved with the general object of overcoming disadvantages of prior art apparatus and of providing apparatus which is highly effective in cleaning sewers and which is inexpensive in construction, readily operated and otherwise satisfactory from a practical standpoint.

An important aspect of the invention is in the discovery that effective cleaning action can be obtained by properly directing the flow of the liquid conveyed in a sewer. Through experimental efforts, using a number of devices of different constructions, it has been found that sand and other debris can be removed from a sewer by directing the flow of the liquid in a manner such as to hydraulically agitate and release the debris and to cause the debris to be carried in a downstream direction.

In accordance with an important feature of the invention, a restricted flow path is provided such that the flowing liquid is concentrated into a narrowed stream of increased velocity for impact with debris.

Another feature relates to the blocking of liquid flow to produce an accumulation of liquid in a reservoir and to create a substantial pressure head, the stored potential energy so created being transformed into kinetic energy in the form of an increased velocity of the narrowed stream.

A further feature relates to directing the narrowed stream sharply downwardly to impact debris on the downstream side of the apparatus.

In an illustrated embodiment, a blocking means is provided which is of generally annular, form and which has one opening or a plurality of openings being provided at the center, from which the fluid is directed sharply downwardly in a narrowed stream, the apparatus being operative at any angular position.

Another feature of the invention relates to the provision of support means such as to maintain the flow directing structure at the proper orientation relative to the pipe and also to permit movement within the pipe so as to advance in a downstream direction behind agitated and released debris. Preferably, well means are provided on the support structure to facilitate its movement. By providing a plurality of wells in angularly spaced relation, the apparatus may be positioned at any desired angular position.

A further feature relates to the provision of control means for controlling the effective cross-sectional area of the narrowed stream in accordance with operating conditions. When the volume of flow of liquid in the sewer is large, it is found to be desirable to increase the effective cross-sectional area but when the rate of flow is smaller, it is desirable to decrease the cross-sectional area in order to obtain increased velocity for impact with the debris.

In an illustrated construction, a plate is movable against the rearward, upstream side of an annular blocking means to partially close a central opening therein, the plate preferably having a plurality of lobes such that a plurality of openings are provided. The plate is spring urged toward a minimal flow position but may be moved rearwardly in an upstream direction for increased flow. A cable is connectable to the flow control plate to permit manual control thereof from a distance, and the cable may also be used as a tether to permit movement of the apparatus in an upstream direction, either when complete withdrawal of the apparatus is desired or when it is desired to back away from troublesome obstructions.

Additional features of the invention relate to the manner of construction of the apparatus. One feature is in the provision of a diaphragm element of a resilient elastomeric material for engagement with the inside surface of the pipe, serving to substantially block flow for creating the aforementioned liquid reservoir. To the extent that the liquid escapes around the sides of the diaphragm, it moves at a quite high velocity to facilitate removal of the debris.

This invention contemplates other objects, features and advantages which will become more fully apparent from the following detailed description taken in conjunction with the accompanying drawings.

DESCRIPTION OF A PREFERRED EMBODIMENT

Figure 2:
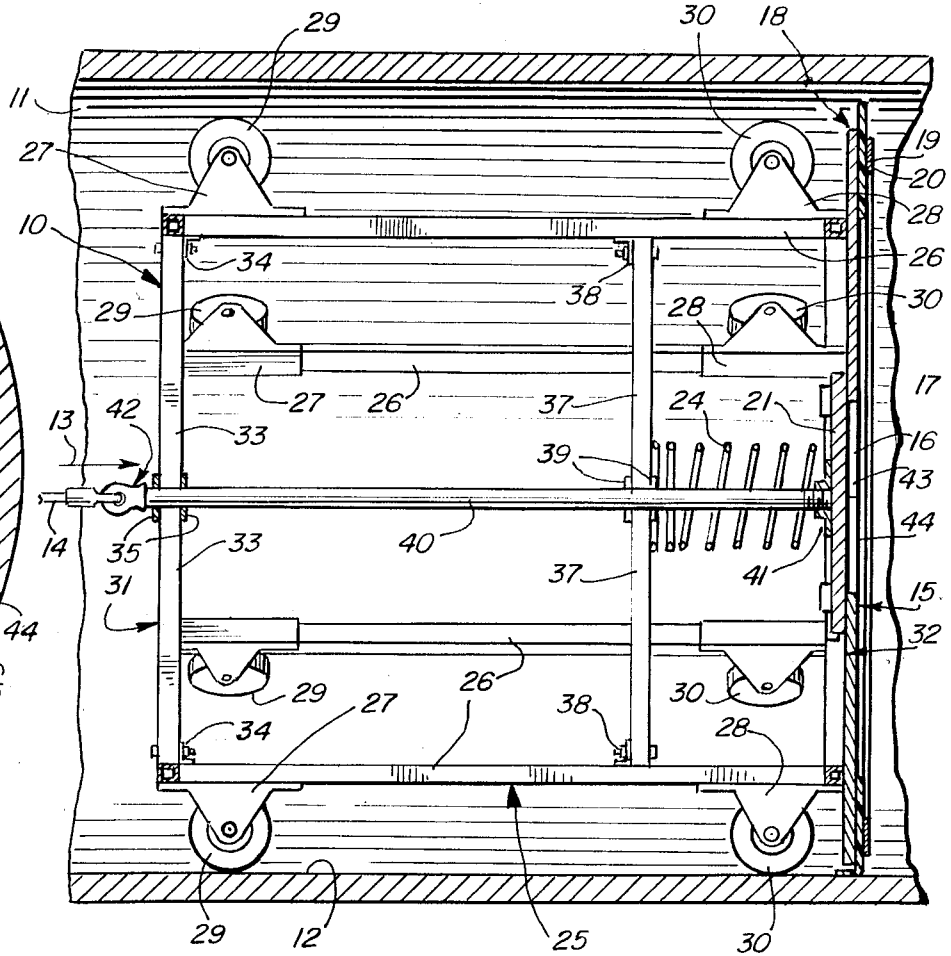
FIG. 2 is a sectional view taken substantially along line II—II of FIG. 1.
Figure 1:
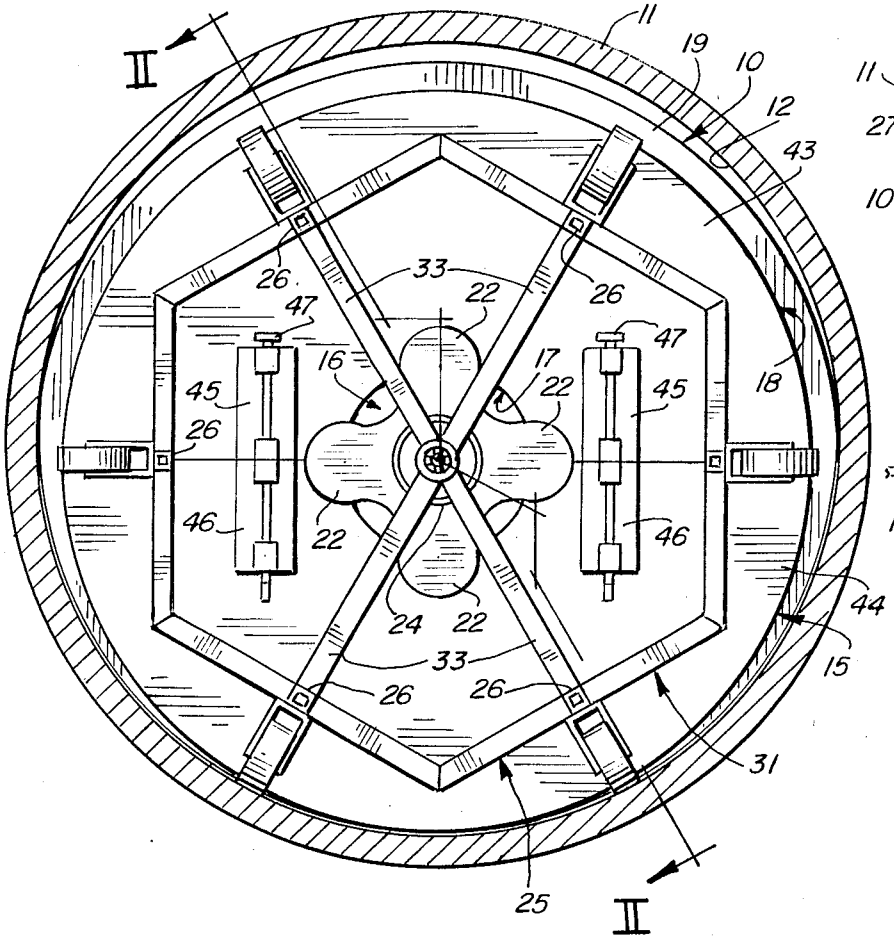
FIG. 1 is an end elevational view of a sewer cleaner constructed in accordance with the invention, shown disclosed in a sewer pipe.

Reference numeral 10 generally designates a sewer cleaner constructed in accordance with the principles of this invention. In the operation of the cleaner 10, it is lowered through a manhole or the like to be positioned in a sewer pipe 11 as shown, in engagement with an internal surface 12 of the pipe. Liquid sewage flowing in the pipe 11, in a direction as indicated by arrow 13 in FIG. 2, builds up on the left-hand, rearward or upstream side of the cleaner 10 and tends to move the cleaner 10 along with the flow. Movement of the cleaner 10 is retarded by friction and by engagement with sand or other debris which may have accumulated in the pipe 11. The liquid then flows through openings in flow directing means of the device in a manner such as to hydraulically agitate and release the debris, to cause the debris to be carried by the liquid sewage in a downstream direction. Then as the debris is moved downstream ahead of the device 10, the device 10 may be moved forwardly by the liquid in a downstream direction.

A cable 14 is connected to the device and is used to control operation thereof in a manner as hereinafter described. It may also be used as a tether to pull the cleaner back to a position in which it may be removed from the sewer. Also, when a particularly stubborn obstruction is encountered, the cleaner can be pulled back a few feet and then released to develop a forward momentum facilitating clearing of the obstruction.

The flow directing means of the illustrated cleaner includes a blocking ring 15 which may be of plywood or other sheet material and in the elevational view of FIG.

1, it is shaped as a doughnut with a central opening 16 and with concentric inside and outside circular edges 17 and 18. A flexible diaphragm 19 of elastomeric material is secured to the front of the peripheral part of the blocking ring 15, being clamped between the ring 15 and a retainer ring 20 which may be of aluminum, for example. The blocking ring 15 together with the diaphragm 19 restricts flow in the lower portion of the pipe 11 while permitting flow through the central opening 16 when the liquid builds up to a certain level. The flow is restricted by the size of the opening 16 and is further restricted by a flow control or regulator member 21 which is engaged with the rearward side of the blocking ring 15. As illustrated, the flow control or regulating member 21 has four radially extending lobes 22, there being spaces between the lobes 22 which register with the opening 16 and through which the liquid may flow.

In flowing through the restricted openings thus provided, the velocity of the flowing liquid is greatly increased and since the openings are elevated, the velocity is additionally increased when the liquid impinges upon sand or other debris in the lower portion of the pipe. The high velocity liquid impacts the debris and agitates and stirs up the debris so that it mixes with the liquid to be carried with the liquid in a downstream direction.

The liquid may also escape between the periphery of the diaphragm 19 and the inside surface 12 of the pipe, especially at higher levels or when the cleaner encounters a solid obstructing object such as a rock or brick. In that case, the hydraulic pressure of the liquid is applied directly against the obstructing object to move it along in the downstream direction. When a particularly stubborn obstruction is encountered, the flow control or regulator member 21 may be moved rearwardly against the force of a coiled compression spring 24, by pulling on the cable 14. Then the central opening 16 of the blocking ring 12 is fully opened to cause a large flush of the liquid which is sufficient to move the obstruction, in most cases.

However, if several attempts do not dislodge an obstruction, the cleaner 10 can be moved back by pulling on the cable 14 and after it is pulled back a dozen feet or so, it may be released. Then the cleaner is accelerated forwardly to develop a forward momentum which is applied against the obstruction and in most cases, the obstruction can be cleared even though particularly stubborn.

The blocking ring 15 and associated components are supported on a support means which is such as to maintain the blocking ring 15 in a position transverse to the axis of the pipe 11, while allowing the cleaner to move freely in a downstream direction, clearing debris and obstruction in its path. The support means is also such as to allow operation of the cleaner at any angular orientation relative to the pipe and the device need not be weighted to maintain it at a particular angular orientation.

The support means includes a support frame 25 which is of a hexagonal shape and which includes six longitudinally extending frame members 26 in equiangularly spaced relation and in parallel relation to the central axis of the device, at equal radial distances therefrom. Each of the members 26 carries rearward and forward brackets 27 and 28 which support and journal rearward and forward rollers 29 and 30 engageable with the inside surface 12 of the pipe 11.

The support frame 25 also includes rearward and forward rings 31 and 32 of hexagonal shape, the center of each of the six sections of each ring being secured to an end of one of the longitudinally extending members 26. The forward ring 32 is bolted, screwed or otherwise secured to the blocking ring 15.

In addition, the support frame means includes a pair of assemblies of X-shaped configuration for rigidifying the support frame 25 and for support of actuating means for the flow control or regulator member 21. A rearward assembly includes four members 33, the outer end of each member 33 being secured to the rearward end of one of the frame members 26 by a bolt and bracket assembly 34. The inner ends of the members 33 are welded or otherwise secured between a pair of washers or collars 35.

A similar forward X-shaped assembly is provided which includes four members 37 having outer ends secured to members 26 by bolt and bracket assemblies 38, inner ends of the members 37 being welded or otherwise secured between a pair of washers or collars 39.

The members 37 of the forward assembly are spaced behind the blocking ring 15 and provide a support for the rearward end of the spring 24 which urges the flow control member 21 forwardly. A shaft 40 slideably extends through the washers 35 and 39 and the forward end of the shaft 40 is secured to the rearward side of the flow regulator or control member 21 by a flange 41. The rearward end of the shaft 40 is coupled to the cable 14 to a suitable coupling 42.

The frame structure 25 is light in weight and the various members thereof may, for example, be formed of steel tubing of square cross-sectional shape which are joined together by welding or through the use of bolts such as the illustrated bolts which secure the members 33 and 37 to the brackets 34 and 38. For larger sewers which are oftentimes accessible only through manhole openings smaller than the sewers, it is desirable to be able to complete assembly of the cleaner in the sewer. For this reason, the blocking ring 15 preferably may be formed from two sections 43 and 44, a pair of brackets 45 being secured to the section 43 and another pair of brackets 46 being secured to the section 44 with a pair of pins 47 being inserted through openings in such brackets to hold the two sections 43 and 44 in coplanar alignment. The members of the forward ring 32 may then be screwed or bolted to the members 43 and 44 which form the blocking ring 15. Then the diaphragm 29 may be secured to the blocking ring 15, by extending screws or bolts through the retaining or clamping ring 20.

By way of example and not by way of limitation, the cleaner as illustrated may be used for a sewer having an inside diameter of 42 inches. The diaphragm 19 may have an outside diameter of 42 inches, about equal to the inside diameter of the pipe, and an inside diameter of about 30 inches and it may be of rubber with a thickness of $\frac{3}{8}$ inches. The retainer ring 20 may have an outside diameter of 38 inches and an inside diameter of 34 inches, with eighteen $\frac{1}{4}$ inch holes, equal angularly spaced, on a circular diameter of 36 inches. The blocking ring 15 may be formed of $\frac{3}{4}$ inch plywood with an outer diameter of 39 inches and an inner diameter of 10 inches. The flow control or regulator member 21 may be formed of $\frac{3}{4}$ inch of plywood and it may cover approximately 70% of the opening 17. The frame members may be of one inch square steel tubing and the actuating shaft 40 for the flow regulator 21 may be of $\frac{3}{4}$ inch pipe, the flange 41 being a standard $\frac{3}{4}$ inch round floor flange of steel. For sewer pipes of other diameter, proportionate dimensions may be used and it will also be understood that other materials may be used.

The cleaner 10 may thus be very inexpensive in construction, using standard readily available parts. At the same time, it is rugged and durable and capable of withstanding the forces applied thereto in operation. More importantly, it is highly efficient in cleaning sewers. Cleaners having a construction substantially as illustrated have been successfully tested in cleaning sewer pipes from 15 inches in diameter up to 72 inches in diameter, including sewer pipes that have been filled with sand up to as much as $\frac{2}{3}$ of their depth.

It will be understood that modifications and variations may be effected without departing from the spirit and scope of the novel concepts of this invention.

I claim:

1. Apparatus for cleaning a sewer pipe or the like positioned generally horizontally for flow of liquid sewage therethrough, comprising: a support structure arranged to be disposed in the pipe, and flow directing means supported by said support structure and arranged to so direct liquid normally flowing in the sewer pipe as to hydraulically agitate and release debris and cause the debris to be carried by the liquid in a downstream direction, said flow directing means comprising means of annular form defining blocking means to substantially block flow in the lower part of the pipe and to define an opening for directing flow from an elevated region in proximity to a central longitudinal axis of the pipe, a flow control member movable between a first position in which said opening is open and a second position in which said opening is partially closed and of restricted area for obtaining in said second position a liquid stream having a smaller cross-sectional area and a larger horizontal velocity component, spring means acting to normally place said flow control member in said second position, cable means connected to said flow control member for acting against said spring means and moving said flow control member from said second position to said first position and to obtain a liquid stream having a larger cross-sectional area and mass per unit length and a smaller horizontal velocity component to fall more directly downwardly on debris on the downstream side of the apparatus, said cable means being also operative as a tether for moving said apparatus in an upstream direction, said apparatus being operable with said control member in said second position to be moved longitudinally in the pipe by liquid sewage normally carried by the pipe and to advance in a downstream direction behind debris agitated by the liquid stream which flows through said partially closed opening, and said apparatus being operable upon movement of said control member to said first position to allow liquid to drop with a flushing action from the upstream side of said apparatus and through said elevated region of said opening onto debris on the immediate downstream side of the apparatus.

2. In apparatus as defined in claim 1, an open frame structure on the upstream side of said blocking means in a position generally transverse to said central longitudinal axis of the pipe.

3. In apparatus as defined in claim 2, a plurality of angularly spaced pairs of longitudinally spaced wheel means on said frame structure for engagement with the inside surface of the pipe.

4. In apparatus as defined in claim 2, said blocking means including a peripheral portion of elastomeric material for engagement with the inside surface of the pipe, and a substantially rigid portion secured to said frame structure within said peripheral portion and around said opening, and wheel means on said frame structure arranged for engagement with the inside surface of the pipe to facilitate movement and to maintain said blocking means in substantially transverse relation to the axis of the pipe.

* * * * *